US005893211A

United States Patent [19]

Hotani

[11] Patent Number: 5,893,211

[45] Date of Patent: Apr. 13, 1999

[54] ELECTRIC SHAVER AND A METHOD OF MANUFACTURING AN OUTER BLADE

[75] Inventor: Yoshiaki Hotani, Tsuna-gun, Japan

[73] Assignee: Sanyo Electric Co., Ltd., Osaka, Japan

[21] Appl. No.: 08/842,518

[22] Filed: Apr. 24, 1997

[30] Foreign Application Priority Data

| | | | |
|---|---|---|---|
| Apr. 26, 1996 | [JP] | Japan | 8-107850 |
| Apr. 26, 1996 | [JP] | Japan | 8-107851 |
| May 30, 1996 | [JP] | Japan | 8-136811 |

[51] Int. Cl.[6] ..... B26B 19/10

[52] U.S. Cl. ..... 30/43.92; 30/346.51

[58] Field of Search ..... 30/43.92, 346.51, 30/43

[56] References Cited

U.S. PATENT DOCUMENTS

| | | | |
|---|---|---|---|
| 2,031,519 | 2/1936 | Winans | 30/346.51 |
| 2,206,551 | 7/1940 | Muros | 30/346.51 |
| 2,266,885 | 12/1941 | Martin | 30/43 |
| 2,325,606 | 8/1943 | Hanley . | |
| 2,331,274 | 10/1943 | Martin | 30/43 |
| 3,002,276 | 10/1961 | Kobler | 30/43.92 |
| 3,037,280 | 6/1962 | De Paoli | 30/43.92 |

FOREIGN PATENT DOCUMENTS

| | | | |
|---|---|---|---|
| 603429 | 10/1953 | Canada | 30/43.92 |
| 680 697 | 9/1939 | Germany . | |
| 870959 | 3/1953 | Germany | 30/43.92 |
| 1 002 659 | 2/1957 | Germany . | |
| 11 14 117 | 9/1961 | Germany . | |
| 1 927 032 | 6/1970 | Germany . | |
| 82 27 546 | 10/1982 | Germany . | |
| 44 13 352 | 5/1995 | Germany . | |
| 6-190157 | 7/1994 | Japan . | |
| 469782 | 8/1937 | United Kingdom | 30/43.92 |
| 469816 | 8/1937 | United Kingdom | 30/43.92 |
| 93/12916 | 7/1993 | WIPO . | |

*Primary Examiner*—Hwei-Siu Payer

*Attorney, Agent, or Firm*—Wenderoth, Lind & Ponack, L.L.P.

[57] ABSTRACT

The electric shaver of the present invention is mounted with the beard cutting blade portion of the inner blade moving in a reciprocating motion and rubbing the inner face of the outer blade having several slit ports for introducing the beard. The width of the outer blade becomes wider in a tapered manner towards the extremity. In a preferred form, the cross-sectional shape of the inner blade is an upside down "J", and a space for introducing the beard is formed in the lower part of the beard cutting blade portion.

3 Claims, 16 Drawing Sheets

ELECTRIC SHAVER AND A METHOD OF MANUFACTURING AN OUTER BLADE

BACKGROUND OF THE INVENTION

The present invention relates to a reciprocating motion electric shaver provided with outer blades and inner blades.

The reciprocating motion electric shaver cuts the beard with the outer blades provided with ports introducing the beard and inner blades provided with plural inner blade main pieces that move with a reciprocating motion rubbing the inner face of the outer blade. As to the shape of the outer blades and inner blades of the reciprocating motion electric shaver, the type with the inner blade main pieces formed like a circular arc and outer blade bent like an arch fitting the arc of the inner blade, is widely known.

The reciprocating motion electric shaver with an outer blade shaped with a square cross section, is also known. The outer blades or the inner blades with a square cross section are much easier to manufacture compared with the outer blades bent like an arch, and it is also possible to make them narrower.

Therefore, with the reciprocating motion electric shaver that is provided with more than one outer blade like 2 rows of blades or 3 rows of blades, it is possible to make the head part more compact by making the outer blades square.

The reciprocating motion electric shaver of the prior art with square shaped outer blades or inner blades is shown in FIG. 1 to FIG. 3. In these Figures, the outer blade is numbered 26 and the inner blade 27. The outer blade 26 is formed square, the upper face part 28 is formed horizontal, from each extremity of the upper face part 28, the lateral face part 29 extends down vertically. Each extremity 29 of the upper face part 28 joined to the lateral face part 29 is shaped like an arch to provide a comfortable touch with the skin. Then, from the upper face part 28 to the upper part of each lateral face part 29 slit ports are provided to introduce the beard in. Then the outer blades 26 are fixed to the head part, of the body of the reciprocating motion electric shaver.

The inner blade 27 is shaped square. Furthermore, on the inner blade, the inner blade base 30 made of stainless steel or other, has a square bend and in the square bent part several parallel slits 31 are formed. As a result, owing to the thin parts located between the slits 31, the inner blade 27 is shaped with several inner blade main pieces 32. Each inner blade main piece 32 is composed of the base part 33 connected to the inner blade base 30 and of the beard cutting blade portion 34 connecting each opposing part of each extremity of the base part 33. Compared with the base part 33 that is formed vertically, the beard cutting blade portion 34 is formed perpendicularly horizontal. The upper face of the beard cutting blade portion 34 is formed by the sharply grinded edge 35. The inner blade 27 is located at the position where it contacts and rubs the inner face of the outer blade 26 and it is connected to the motor built-in in the reciprocating motion electric shaver to drive the reciprocating motion.

The length of upper face part 28 of the outer blade 26 is designed to be a little longer than the length of the beard cutting blade portion 34 of the inner blade main piece 32. Therefore, there is a gap between the lateral face part 29 of the outer blade 26 and the opposing base part 33 of the inner blade main piece 32. Through the existence of this gap, the beard is introduced more easily through the lateral face.

The beard that has been introduced by the slit port 4 of the outer blade 26, is cut by the edge 35 of the inner blade main piece 32. The edge 35 formed by the beard cutting blade portion 34 of inner blade main piece 32 and because it is formed by the span A of the FIG. 3, will not cut the beard if the beard that has been introduced, does not reach this span A. Nevertheless, in the case of a vicious beard like a long beard, it is very often introduced from the lateral face part 29 of the outer blade 26, and in this case because of the existence of the inner blade base 30, the space where the beard is introduced, is limited. For example, as shown in FIG. 3, the beard that has been introduced from the left side of the lateral face part 29 of the outer blade 26, is obstructed by the inner blade base 30 and cannot reach the span A. As a result, a vicious beard like a long beard cannot be shaved and unshaved zones will be left.

Furthermore, the outer blade of the hereabove construction has also the drawback that it is not able to pull the totality of the vicious beard into the slit ports. It is possible to improve the introduction of the vicious beard of the outer blade by making the slit ports wider. But, when making the slit ports wider, the, consequence is that the skin can more easily be damaged. The skin is pressed into the wide slit ports, and cut by the inner blade that rubs the inner face. To be able to protect the skin, the width of the slit ports is made narrower, the introduction of the vicious beard is proportionally worthless. Being able to cut the vicious beard precisely with the outer blades and not damage the skin are two opposite specific characteristics.

Because the present invention has been developed to solve the above drawbacks, the first purpose of the present invention, reducing the damage of the skin, is to supply an electric shaver that can precisely cut a vicious beard.

By the way, square shaped outer blades can be mass produced at low cost, by embossing a metallic sheet. By this method, after having opened the slit ports by embossing the flat metallic sheet, the latter is square bent. By this method it is possible to produce a large quantity of outer blades with a high efficiency but it is not possible to produce an ideal shape that cuts very well. It is possible to improve the cutting of the outer blade by sharpening the angle of the edge formed by the opposite face of the slit ports and the outer blades of the inner face. But in the manufacturing process by embossing, it is not possible to manufacture an edge with a sharper angle. Furthermore, to improve the cutting of the slit port and the inner blade it is necessary to position the inner blade a little slant compared with the slit ports. With this structure, the inner blade and the slit ports, like cutting the beard with scissors, approaching and crossing together, precisely cut the beard. But to be able to realize this structure, it is necessary to make the slit ports and the inner blade slant, and the manufacturing is then more difficult.

The second purpose of the present invention, is to solve this drawback, that is to say, to propose a manufacturing method of the outer blades of an electric shaver, that allows a low price, and simple and easy large quantity manufacturing of sharp outer blades.

Furthermore, the inner blade 27 shown in FIG. 1 and FIG. 2, is formed by folding one sheet of stainless steel at 180 degrees to obtain a horizontal "U" shape. Therefore, the inner blade base 30 is positioned opposite with a fixed interval. For this reason, because the width of the inner blade 27 gets wider only where there is this interval, this hinders the miniaturization.

Furthermore, because the process of folding the inner blade base 30 is necessary, the production cost increases. Then, to allow the folding, because it is not possible to augment the thickness of the inner blade base 30, the drawback is that a large mechanical resistance cannot be reached.

The third purpose of the present invention is to supply an electric shaver provided with an inner blade with a high mechanical resistance, miniaturized and that can be manufactured extremely easily.

The above and further objects and features of the invention will more fully be apparent from the following description with accompanying drawings.

SUMMARY OF THE INVENTION

The electric shaver of the present invention has provided a space for introducing the beard in the lateral face span of the inner blade opposite to the lateral face of the outer blade, to pull the beard that has been introduced into the inner face of the outer blade, to the shaving span of the inner blade, and to cut it.

The inner blade that is provided with a beard introducing space, pulls the beard that has been introduced in the inner side of the outer blade, to the beard cutting blade portion and cuts it precisely. Therefore, when shaving a vicious beard like a long beard, even if the beard is introduced from the lateral face part of the outer blade, it is possible to shave the vicious beard with no unshaved zone, by anabling the beard to reach the beard cutting blade portion.

Furthermore, with the electric shaver of the present invention, to improve the introduction of the beard, the width of the slit ports provided in the outer blade has been made tapered in the direction of the extremity. When moving the outer blade along the skin, the beard is introduced in the slit port from the wide extremity.

An outer blade of this structure can be efficiently produced in large quantity by the process hereunder described. Cutting the slits at the extremity, the rectangular metallic sheet is provided with several slit ports. Turning the revolving shaft fixed with several grinding discs, the slit ports are cut and shaped by each grinding disc. The grinding disc that cuts the rectangular metallic sheet is a disc that gets progressively thinner towards the outer circumference. Compared with the direction of the radius of the grinding disc, the rectangular metallic sheet is cut in a slant posture. In the rectangular metallic sheet cut in this posture, the slit ports provided at the extremities, are cut deeper at one end than at the other end. The width of the deeper slit port, is manufactured wider than the width of the shallower slit port. Then, the edge degree that is made by the opposite face of the slit port and the outer blade inner face is cut sharply by the grinding disc.

The outer blade of this construction realizes the very outstanding characteristics of limiting the damage to the skin, and of precisely cutting the vicious beard. And for the electric shaver characteristics that are contrary to each other, this is the realization of the two important characteristics in an ideal condition. This is because when the outer blades move along the skin, the beard is cut, being inserted rapidly into the slit ports from the wide part. The outer blade of this construction does not make wider the width of the totality of the slit ports. The width of the extremity is made progressively wider. Making wider the important extremity that leads the vicious beard in, the beard is rapidly guided and the part cutting the introduced beard is not made wider on its entire width. For this reason, it is possible to rapidly lead the beard into the slit ports, but because the width of the totality of the slit ports is not made wide, it does not cause any damage to the skin.

Furthermore, the slit ports whose widths are made larger toward the extremities, have their opposing sides not parallel together, but slant. The slant slit ports trim the beard off in a position where it crosses the inner blade that is rubbing against the inner side. This cutting condition improves the cutting quality reliably by cutting the beard like it was cut with scissors. By not making the blade plate of the inner blade slant, because it rubs at the position where it crosses the slit ports, there is also important to be able to manufacture the inner blades easily.

Furthermore, the electric shaver of the present invention, with the inner blades made with the hereunder construction, can be mass produced at low cost. The inner blade is shaped with several blade ditches, at one side of the inner blade main material it is a flat sheet. At each adjacent ditch interval, the upper extremity of each protuberance part that is formed at each adjacent ditch interval, is grinded and the beard cutting edge is formed.

The inner blade of this construction, like the inner blade of the prior art, is not formed by folding one metallic sheet, and because it is realized by shaping the blade ditch at one side of the inner blade main material that is a flat sheet, it can be extremely easily assembled by avoiding the folding process. Furthermore, the thickness of the inner blade being the same as the thickness of the material of one inner blade main piece, it is possible to make the inner blade thinner. Then, because folding is not necessary, and because it is possible to make the main material itself thicker compared with the one of the prior art, it is then possible to improve the mechanical strength.

DETAILED DESCRIPTION OF THE INVENTION

Figure 1:
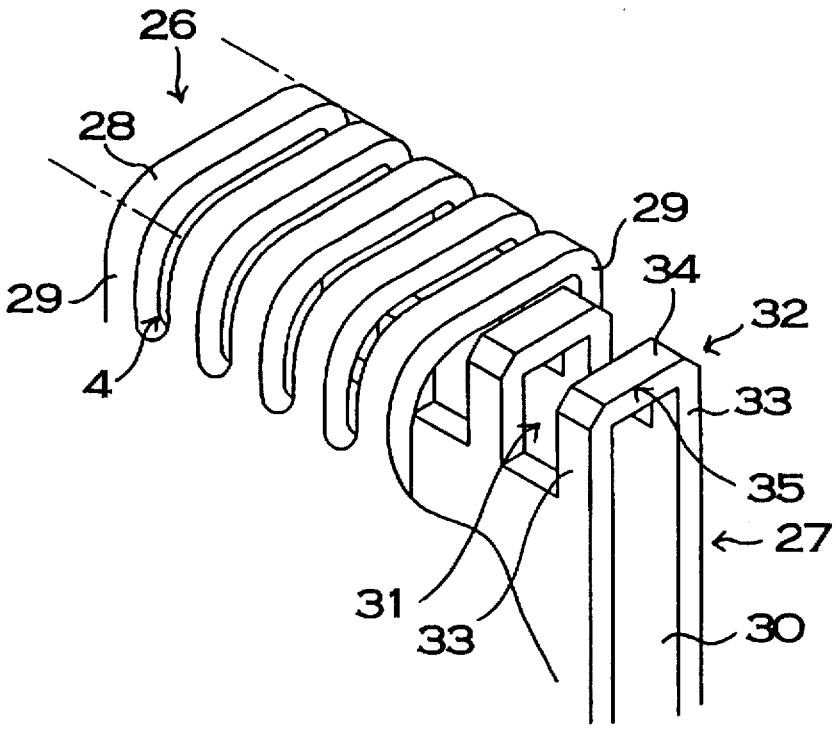
FIG. 1 PRIOR ART
FIG. 1 is an oblique view showing the outer blade and the inner blade of a prior art electric shaver.
Figure 2:
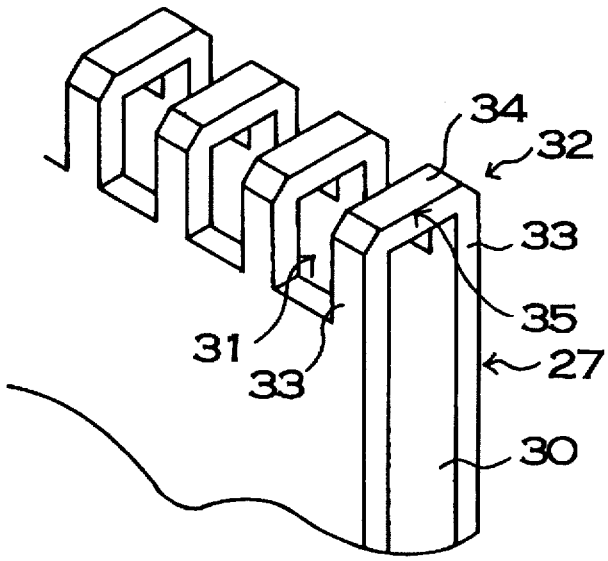
FIG. 2 PRIOR ART
FIG. 2 is an oblique view showing the inner blade of the electric shaver shown in FIG. 1.
Figure 3:
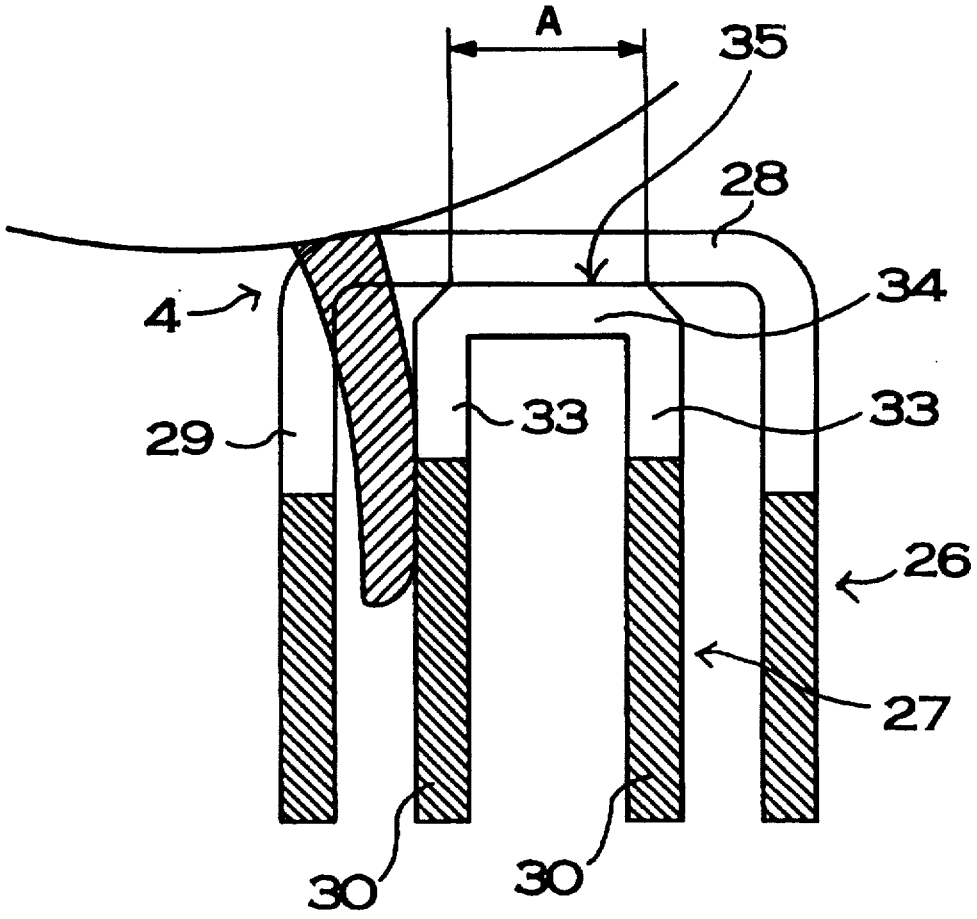
FIG. 3 PRIOR ART
FIG. 3 is cross-sectional view showing the introducing condition of the beard into the outer blade of the electric shaver shown in FIG. 1.
Figure 4:
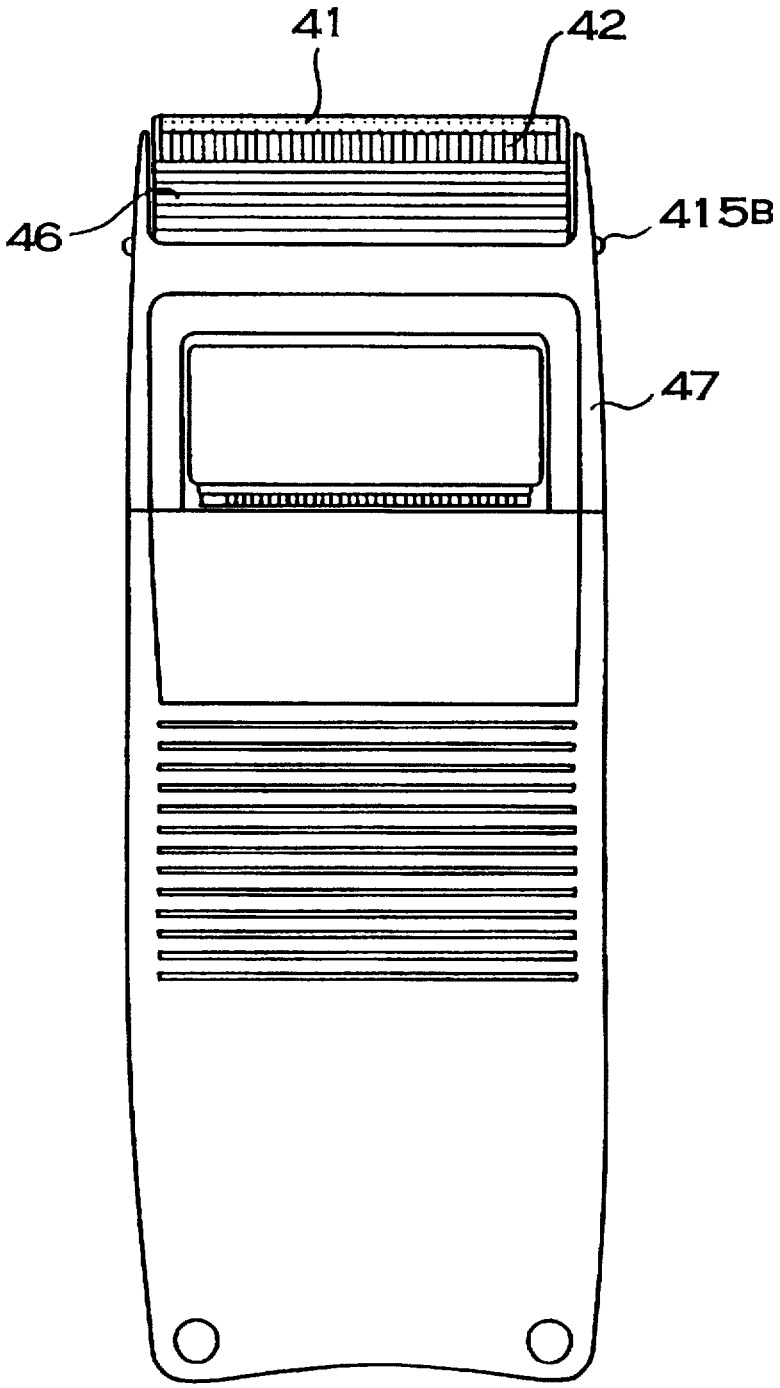
FIG. 4 is a front view showing an embodiment of the electric shaver of the present invention.
Figure 5:
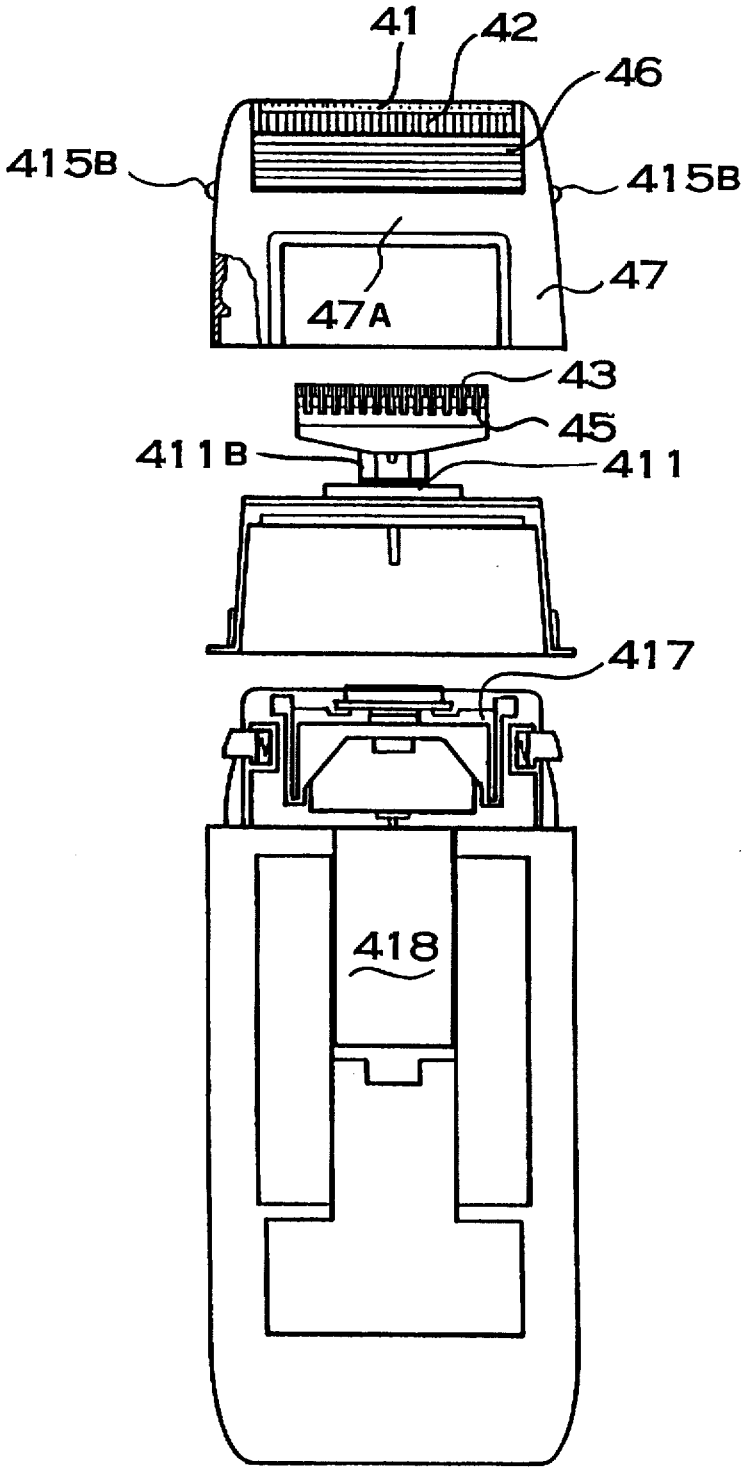
FIG. 5 is an exploded front view showing the electric shaver shown in FIG. 4.

The electric shaver shown in FIG. 4 and FIG. 5 is provided with two rows of arched outer blades 41, two rows of outer blades 42 with slit ports (also referred to as longitudinally extending outer blades with whisker entry ports) mounted at the side of these arched outer blades 41, an outer blade case 46 mounted in a removable fashion including in parallel to the arched outer blades 41 and the outer blades 42 with slit ports, an outer blade frame 47 mounting the outer blade case 46 in a removable fashion, arched inner blades 43 vibrating and pressed into the inner face of the arched outer blades 41, sub inner blades 45 vibrating and pressed into the inner face of the outer blades 42 with slit ports, an inner blade stage 411 coupling the arched inner blades 43 and the sub inner blades 45, and the driving mechanism for the reciprocal motion of the inner blade stage 411.

Figure 6:
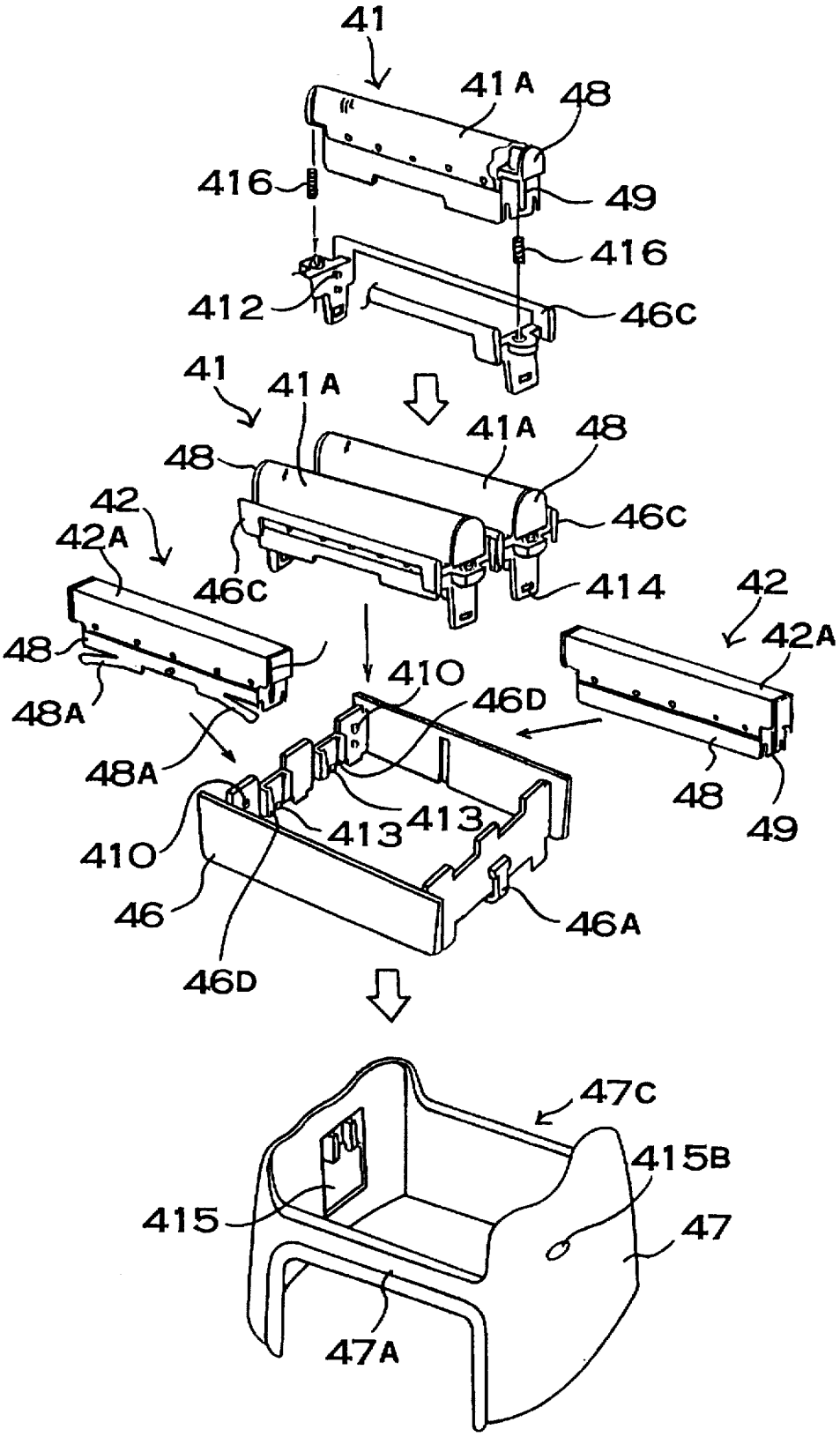
FIG. 6 is an exploded oblique view showing the arched outer blade and the outer blade with the slit ports in an exploded condition, of the electric shaver shown in FIG. 4.

As shown in the FIG. 6, the two rows of arched outer blades 41 and the two rows of outer blades 42 with slit ports are mounted independently in the outer blade case 46. The outer blades 42 with slit ports are mounted in parallel at the sides of the two rows of arched outer blades 41. The arched outer blades 41 are mounted in a position where they protrude more than the outer blades 42 with slit ports. This is to have the beard cleanly shaved by the arched outer blades 41 precisely pressed onto the skin.

As shown in the FIG. 6. the arched outer blades 41 have the mesh cutter 41A fixed in the plastic blade support 48. The mesh cutter 41A is made of a thin metallic sheet with a thickness of for example, from 30 to 100 μm, the best thickness being 50 μm, and fixed to the blade support 48 curved liked an arch. The mesh cutter 41A has numerous beard cutting ports. The blade support 48 is designed like a square column opened on the top and the bottom, and made of hard plastic.

Figure 7:
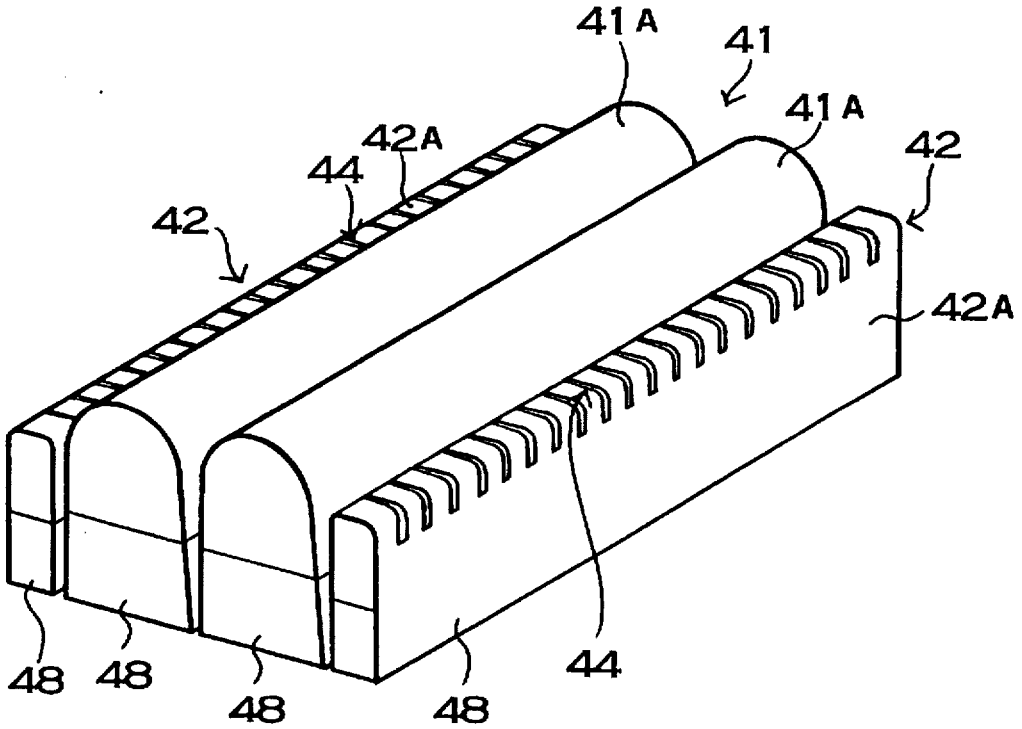
FIG. 7 is an oblique view showing the arched outer blade and the outer blade with slit ports of the electric shaver shown in FIG. 4.
Figure 8:
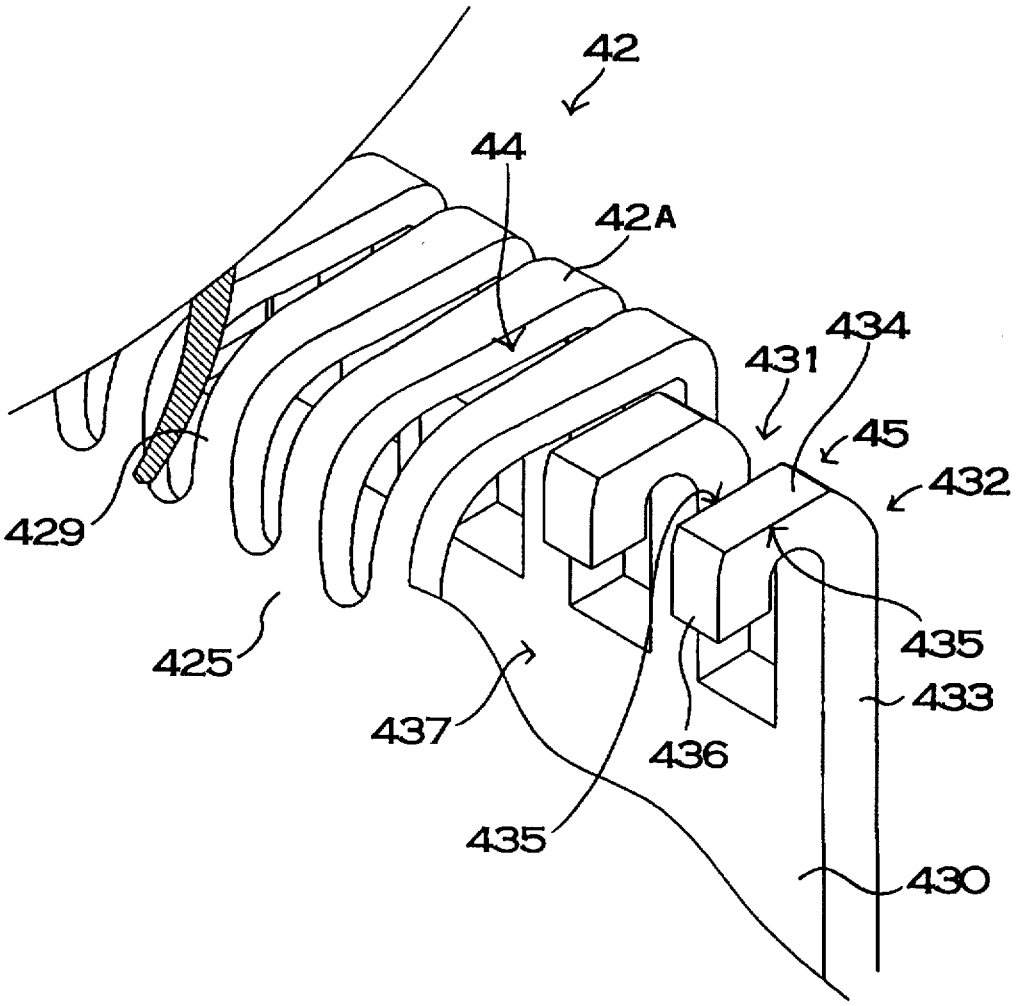
FIG. 8 is an oblique view showing the condition in which the outer blade with slit ports and the sub inner blade introduce the beard into the slit ports and cut it.

The outer blade 42 with slit ports, as shown FIG. 6 and FIG. 7, fixes the parallel blade (beard cutting blade part) 42A to the plastic blade support 48. The parallel blade 42A, as shown in FIG. 8, has numerous ports in the rectangular metallic sheet 425 with the long side placed across. The parallel blade 42A has the slit ports 44 at the upper part, of the rectangular metallic sheet that is bent at a right angle with the upper face flat.

As shown in FIG. 7 and FIG. 8, the parallel+blade 42A of the outer blade 42 with slit ports, provides the slits ports 44 at the upper part of the rectangular metallic sheet 425. As shown in the oblique views of the FIG. 7 and the FIG. 8 and in the plan view of the FIG. 9, the width of the slit ports 44 becomes gradually wider facing the extremity of the outer side from the extremity of the inner side opposite to the arched outer blade 41. Consequently, taking X1 as the width of the inner side and X2 as the width of the outer side, it is designed so that X1<X2. For example, if the width X1 of the inner side is 0.3 to 1 mm, the width X2 of the outer side has to be 1.1 to 2 times X1.

Figure 9:
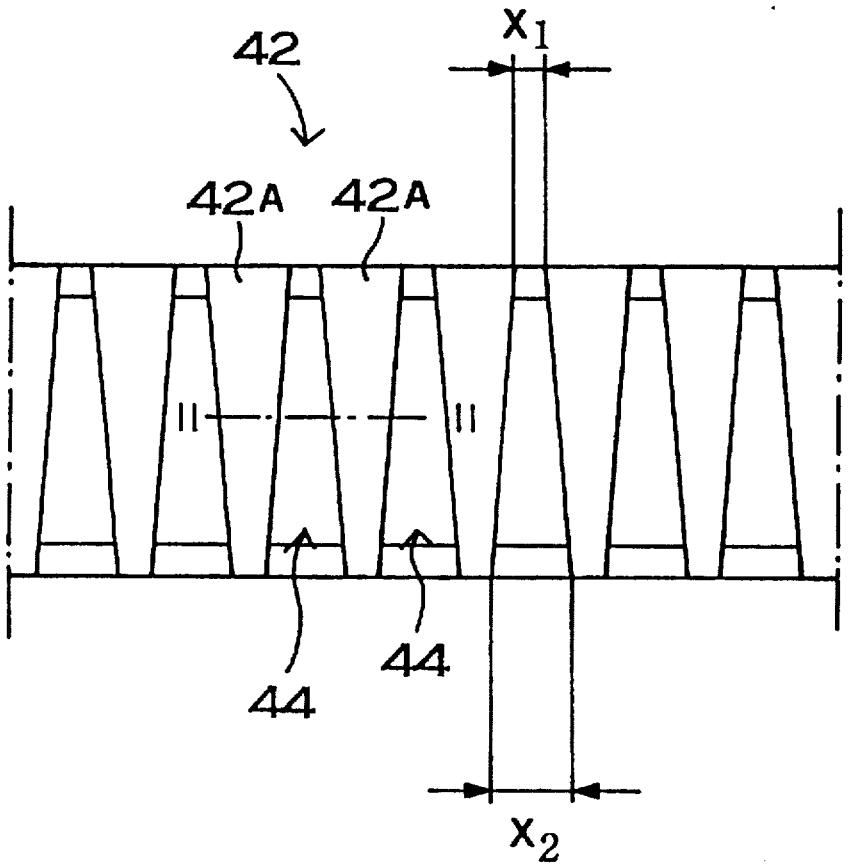
FIG. 9 is a plan view showing the outer blade showing the slit ports shown in FIG. 8.
Figure 10:
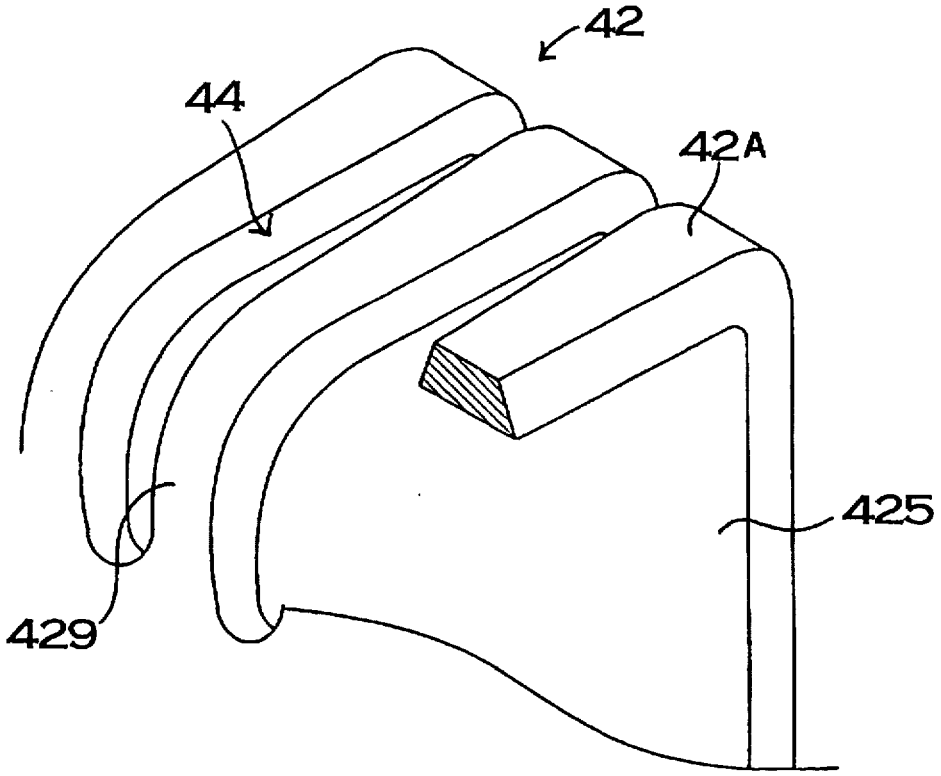
FIG. 10 is a partial cross-sectional oblique view showing the slit ports of the outer blade shown in FIG. 8.
Figure 11:
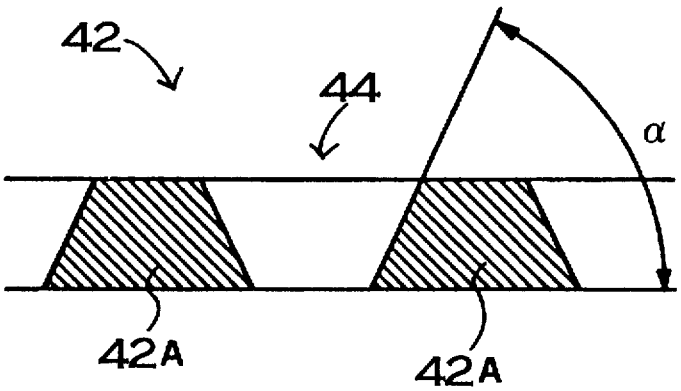
FIG. 11 is a line cross-sectional diagram of the slit ports of the outer blade, along line 11—11 of FIG. 9.

Furthermore, the parallel blade 42A of the outer blade 42 with slit ports, as shown in the FIG. 9 and in FIG. 11 (which shows a cross section along line 11—11 of the FIG. 9), is provided with the edge angle α made by the opposing face of the slit ports 44 and the inner face of the outer blade. The edge angle α, for example 50 degrees to 85 degrees, preferably 55 degrees to 80 degrees, should be designed for optimum results at 60 degrees.

Figure 12:
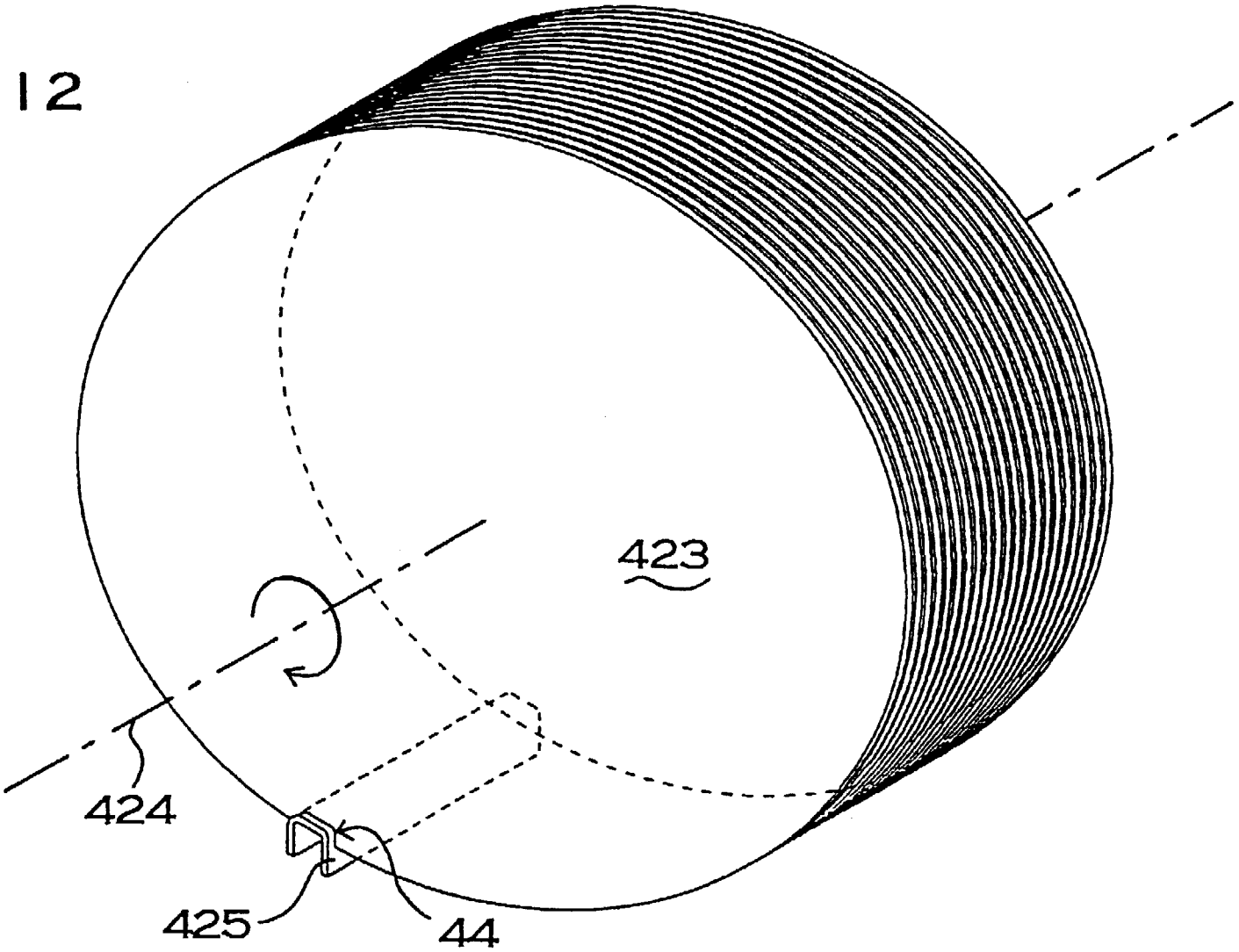
FIG. 12 is an oblique view showing the cutting condition of the rectangular metallic sheet being cut by the grinding disc.
Figure 13:
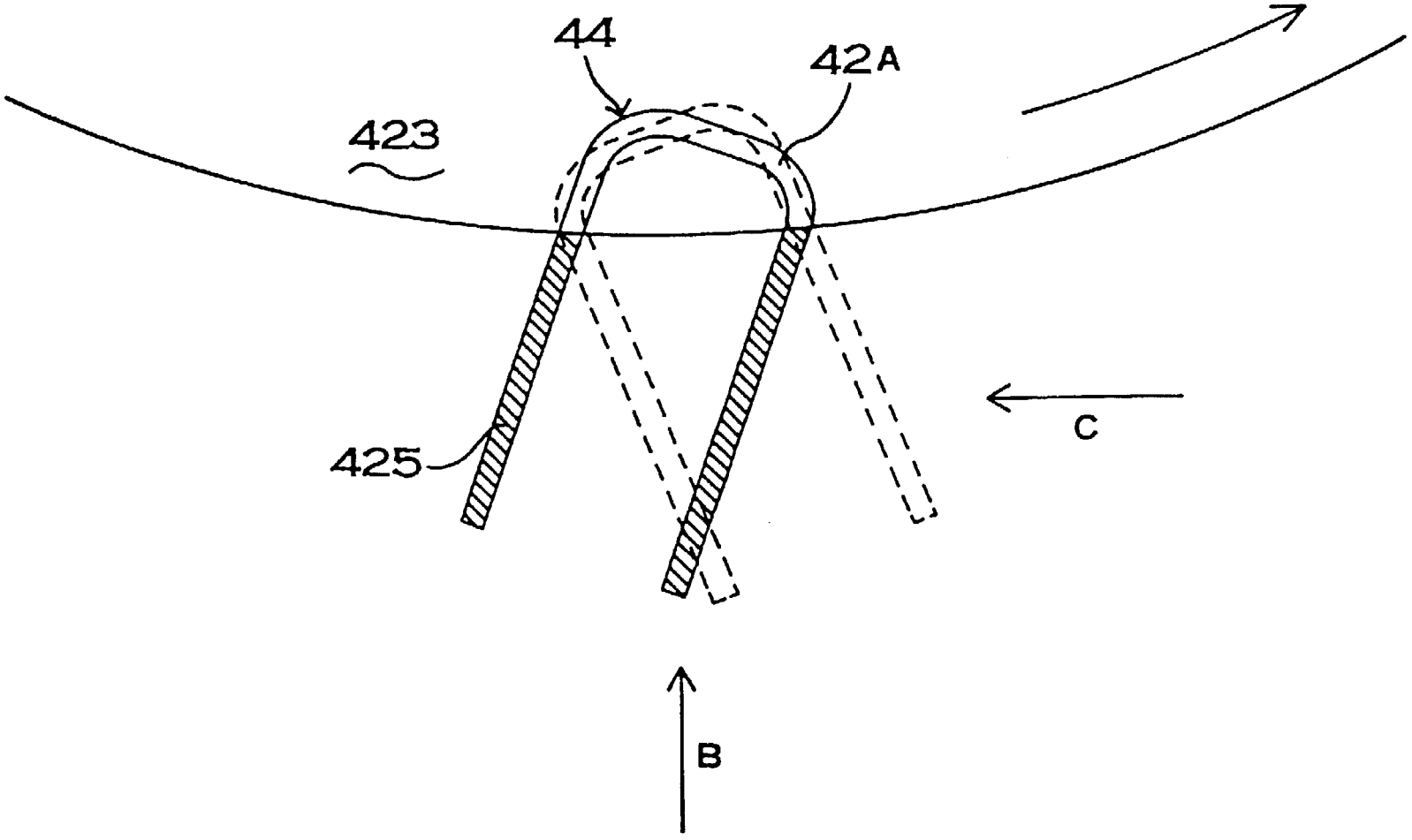
FIG. 13 is an oblique view showing the cutting condition of the rectangular metallic sheet in a slant posture, being cut by the grinding disc.

The parallel blade 42A shown in FIG. 8 and FIG. 9, are manufactured by the method shown in the FIG. 12 and 13. The outer blades 42 with slit ports are manufactured by first manufacturing the parallel blades 42A that have the slit ports 44, then by inserting these into the plastic blade support.

As shown in FIG. 12, the parallel blade 42A is manufactured by cutting slits into the edge of the rectangular metallic sheet 425 with the grinding disc 423, by revolving several grinding discs 423 mounted parallel at a fixed interval on the revolving axis 424. The interval of the grinding discs 423 is the pitch of the slit ports 44. The thickness of the grinding disc determines the width of the slit ports 44.

The grinding disc 423 is made by combining a binder with a grinding material like diamonds or the like, in a circular manner. The outer circumference of the grinding disc is made progressively thinner to cut the slit ports 44 with the edge angle α becoming acute when the width of one extremity becomes progressively larger. As shown in FIG. 13, the rectangular metallic sheet 425 is pushed against the grinding disc 423 in a slant posture compared with the radius direction of the grinding disc 423. The rectangular metallic sheet 425 that has been pushed against the grinding disc 423 in this posture, is cut deeper at one end than at the other, and the width of the slit port 44 that has been cut deeper, is made larger than the width of the slit port 44 that has been cut shallower.

Furthermore, because the outer circumference of the grinding disc 423 is made progressively thinner, the slit ports are cut so that the edge angle α becomes more acute. As shown by the arrow B in the FIG. 13, the slit ports 44 are cut by approaching the rectangular metallic sheet 425 in the direction of the radius of the grinding disc 423, or as shown by the arrow C, the slit ports 44 are cut by approaching in the direction of the tangent.

The width of one extremity of the parallel blade 42A shown in the FIGS. 8 and 9, is made progressively wider than the width of the other extremity. As shown in the FIG. 14, the width of both extremities of the parallel blade 42A of the outer blade, can also be shaped becomes progressively wider from the center. It is possible to manufacture the parallel blade 142A of this shape, by cutting the slit ports 144 in the posture shown by the dotted line of the FIG. 13 after having cut with the grinding disc 423, the rectangular metallic sheet 425 in the posture shown by the full line.

Figure 14:
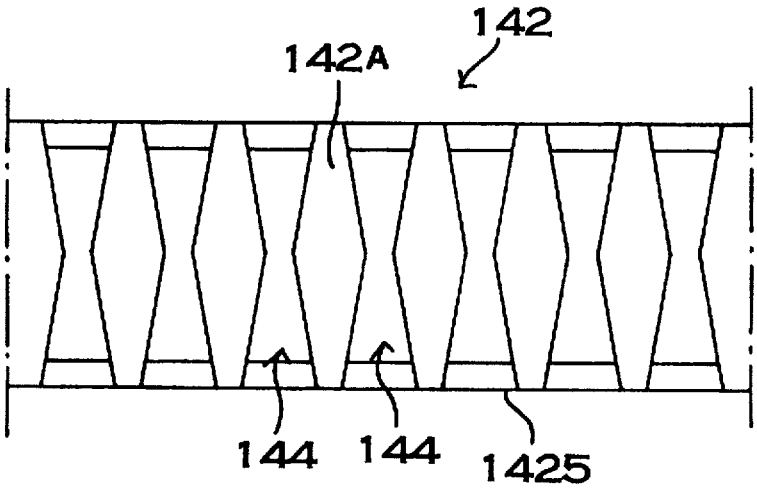
FIG. 14 is a plane diagram showing another example of the outer blade with the slit ports.

As shown in the FIG. 14, the outer blade with both extremities becomes larger from the center, is the optimum blade to be placed between the arched outer blade not shown in this figure. It is best to place the outer blade shown in the FIG. 8 at the external side of the arched outer blade. Mounted at the external side of the arched outer blade, the outer blade can cut the vicious beard in an ideal condition. For this reason, in this embodiment is the detailed explanation of the outer blade mounted at the external face of the arched outer blade.

The thickness of the parallel blade 42A is thicker than the one of the mesh cutter, for example 0.1 to 0.5 mm, optimum from 0.2 to 0.3 mm, 2 to 10 times the mesh cutter, and optimum at 5 times. Making the parallel blade 42A thicker, makes the width of the outer blade 42 wider, and reduces the risk of damaging the skin. To be able to smoothly lead the vicious beard into the slit ports 44, it is necessary to make the width of the slit ports 44 wider. But, when making the width of the slit ports 44 wider, the skin is pressed in and is easily damaged by the sub inner blade 45 rubbing the inner face. To avoid this drawback, the parallel blade 42A is made thicker. As long as the skin is not pushed deeply into the slit ports 44, the thick parallel blade 42A does not damage the skin by the sub outer blade 45.

Making the width of the slit ports 44 larger, the parallel blade 42A that is thicker than the mesh cutter 41A of the beard cutting ports, precisely cuts the vicious beard and also reduces the damage to the skin. The parallel blade 42A of the outer blade 42, roughly cut the beard. The beard that has been roughly cut is finely cut by the arched outer blades 41 that move along the skin, following the outer blade 42 with slit ports. The extremity of the vicious beard that has been cut short, can be easily introduced into the beard cutting ports of the arched outer blades 41, and is cleanly cut by the beard cutting ports.

The arched outer blades 41 and the outer blades 42 with slit ports are independently mounted into the outer blade case 46. For the arched outer blades 41 and the outer blades 42 with slit ports, the mesh cutter 41A or the parallel blade 42A is fixed to the plastic blade support 48 of square column shape.

The blade support 48 of the outer blade 42 with slit ports provided with arched outer blades 41 on both sides, as shown in FIG. 6, is built in one piece with the elastically deformable struts 48A at both extremities projecting from the lower face. The elastically deformable struts 48A are a material flexibly pushing out the outer blade 42 with slit ports. With the shape of a rod, the elastically deformable struts 48A project making a declivity from the center of the blade support 48 towards both extremities. As shown in this figure, the blade support 48 mounted with elastically deformable struts 48A at both extremities, is characteristic in that it can move parallel to the outer blades by the two elastically deformable struts 48A.

The elastically deformable struts 48A press the upper face of the opening 47A of the outer blade frame 47 by the extremity, pushing out the outer blades 42 with slit ports towards the skin. Therefore, in the condition where the outer blades 42 with slit ports are fixed to the outer blade frame 47, the elastically deformable struts 48A protruding downwards from the outer blade case 46, are provided at a position pressing the upper face of the opening 47A of the outer blade frame 47. The electric shaver mounted with four rows of outer blades can press the outer blade 42 with slit ports mounted on both sides, by the upper face of the opening 47A of the outer blade frame 47. The two rows of outer blades 42 with slit ports that are provided on both sides, on one side of the blade support 48, are mounted with the elastically deformable struts 48A on the face that can press the upper face of the opening of the outer blade frame 47A.

The arched outer blade 41 provided at the inner face of the outer blade 42 with slit ports, is pushed out towards the skin, not by the elastically deformable struts, but through the extremity spring 416 that is a coil spring. Consequently there is no need to provide elastically deformable struts on the blade support 48 of the arched outer blade 41. The edge springs 416 press the arched outer blade 41 against the skin with less pressure than the elastically deformable struts with a large stroke. When it is nearly perpendicular to the skin, a quadruple bladed shaver pressing on the skin the arched outer blades 41 lighter than the outer blade 42 with slit ports, the arched outer blades 41 sink deeply until they reach the same level as the outer blades 42 with slit ports, allowing all the four rows of outer blades that is to say the outer blades 42 with slit ports and the arched outer blade 41, to press comfortably against the skin.

The outer blades 42 with slit ports mount in the outer blade case 46 in a manner allowing up and down movement. Therefore, the outer blades 42 with slit ports are provided with vertical slits 49 at both ends of the blade support 48. Guide projections 410 protruding on the inner face of the outer blade case 46 mate with the vertical slit 49. The outer blades 42 with slit ports are mounted in the outer blade case 46 to allow their vertical movement via the vertical slits 49 and the guide projections 410. When the outer blades 42 with slit ports move up and down, the guide projections 410 move up and down within the vertical slits 49. The arched outer blade 41 mounts in the outer blade case 46 in a manner allowing up and down movements via the center blade stage 46C of the outer blade case 46 the outer blade case 46 of this figure, is provided with a center blade stage 46C for coupling the arched outer blades 41.

The arched outer blades 41 in a condition where they are pushed out by the edge spring, are mounted so that they can move up and down in the center blade stage 46C. The center blade stage 46C connects with the outer blade case 46 in a manner that does not allow up and down movements. The structure connecting the arched outer blade 41 to the center blade stage 46C of the outer blade case 46, is the same that mounts the outer blades 42 with slit ports in the outer blade case 46. Namely, vertical slits 49 are provided at both ends of the blade support 48 of the arched outer blade 41, guide projections 412 which insert into the vertical slits 49 are provided on the center blade stage 46C and the guide projections 412 slide within the vertical slits 49 allowing the arched outer blade 41 to move up and down.

The center blade stage 46C connects with the outer blade case 46 by insertion into the connecting columns 46D provided on the inner faces of the outer blade case 46). A locking projection 413 at the lower extremity of each connecting column 46D catches in a locking hole 414 on the inserted center blade stage 46C to prevent, by the locking projection 413, the disconnection of the center blade stage 46C.

Figure 15:
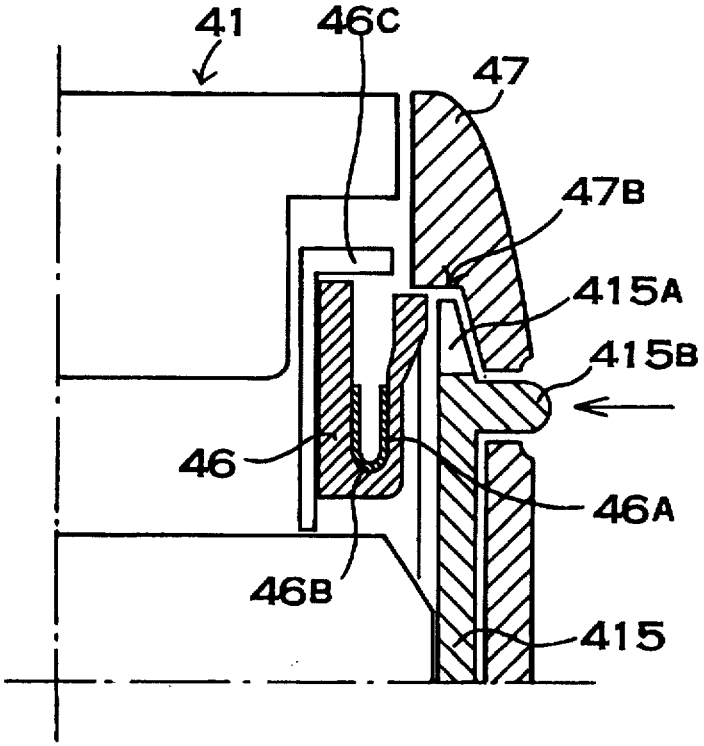
FIG. 15 is partial cross-sectional view of the outer blade case mounted in a removable fashion.

The outer blade case 46 mates with the outer blade frame 47 in a removable fashion. As shown in FIG. 6 and in FIG. 15, the outer blade case 46 is provided with a latching piece 46A which catches in the latching detent 47B and is mounted in a removable fashion in the outer blade frame 47. The latching piece 46A projects out from both extremities of the outer blade case 46 and is extended from the bottom to the top. The latching piece 46A has a built-in flexible sheet metal 46A on its inner face giving it the ability to elastically deform. The upper end of the latching piece 46A is widened giving it a T-shape. As shown in the cross-sectional view of the FIG. 15, the outer blade frame 47 is provided with latching detents 47B which are aligned to catch the latching pieces 46A when the outer blade case 46 is attached. When mounting the outer blade case 46 on the outer the blade frame 47, the latching pieces 4GA slide into the latching detents 47B.

Latch releases 415 are disposed within the latching detents 47B of the outer blade frame 46 to disconnect the outer blade case 46 from the outer blade frame 47. The latch release 415 is formed in one piece and of a flexible plastic. The lower extremity of the latch release 415 is fixed to the outer blade frame 47 allowing the upper extremity to deform elastically. The pressure rods 415A which push against both extremities of the T-shaped latching pieces 46A are formed as a single piece at the upper extremity of the latch release 415. Further the push buttons 415B which project out of the external part of the outer blade frame 47 are also formed in one piece with the latch release 415. The push buttons 415B insert through holes in the outer blade frame 47 in a manner allowing movement in and out. The push buttons 415B are pressed to disconnect the outer blade case 46 from the outer blade frame 47. When the push buttons 415B are pressed, the pressure rods 415A push the latching pieces 463A out of the latching detents 47B releasing the lock between the outer blades case 46 and the outer blade frame 47 and are pulled out from the outer blade frame 47.

The outer blade frame 47 has an opening 47C to accept the outer blade case 46 with almost no gap. The opening 47C aligns the upper face of the opening of the outer blade frame 47 with the lower face of the outer blades 42 with slit ports. The thickness of the opening of the outer blade frame 47 is designed to allow the pressure from the elastically deformable struts 48A provided in the blade support 48. Because it is part of the outer blade case 46, the blade support 48 is preferably made of metal. In the electric shaver shown in the figure, the outer blade frame 47 mounts on the electric shaver body in a removable manner, but it is also possible to integrate in one piece the outer blade frame and the electric shaver body.

As shown in the FIG. 6, the arched outer blade 41 or the outer blade 42 with slit ports, and the outer blade case 46 and the outer blade frame 46 are assembled as follows.

① The arched outer blade 41 is mated to the center blade stage 46C. The arched outer blade 41 mates the vertical slits 49 into the guide projection 412 to connect in the center blade stage 46C.

② The outer blades 42 with slit ports and the arched outer blades 41 connected in the center blade stage 46C are arranged in parallel and mounted into the outer blade case 46. The outer blades 42 with slit ports, mount in the outer blade case 46 through the vertical slit 49 and the guide projection 410. The center blade stage 46C is inserted and coupled with the connecting column 46D of the outer blade case 46.

③ The outer blade case 46 connected with the arched outer blades 41 and the outer blades 42 with slit ports, is inserted in the opening 47C of the outer blade frame 47. In the outer blade case 46 that has been inserted into the outer blade frame 47, the latching pieces 46A arc inserted into the latching detent 47B in a manner that will not become disconnected easily.

In this condition, the outer blades 42 with slit ports mounted in the outer blade frame 47, press in a deformable manner against the upper face of the opening of the outer blade frame 47A by the elastically deformable struts 48A. Through the reaction force of the elastically deformable struts 48A pressing the opening of the outer blade frame 47A, the outer blades 42 with slit ports, being flexibly pushed upward, connect into the outer blade case 46. Therefore, when the electric shaver is used, and the outer blades 42 with slit ports press against the skin, each arched outer blade 41 and each outer blade 42 with slit ports are pressed flexibly against the skin with high efficiency and shave the beard.

Figure 16:
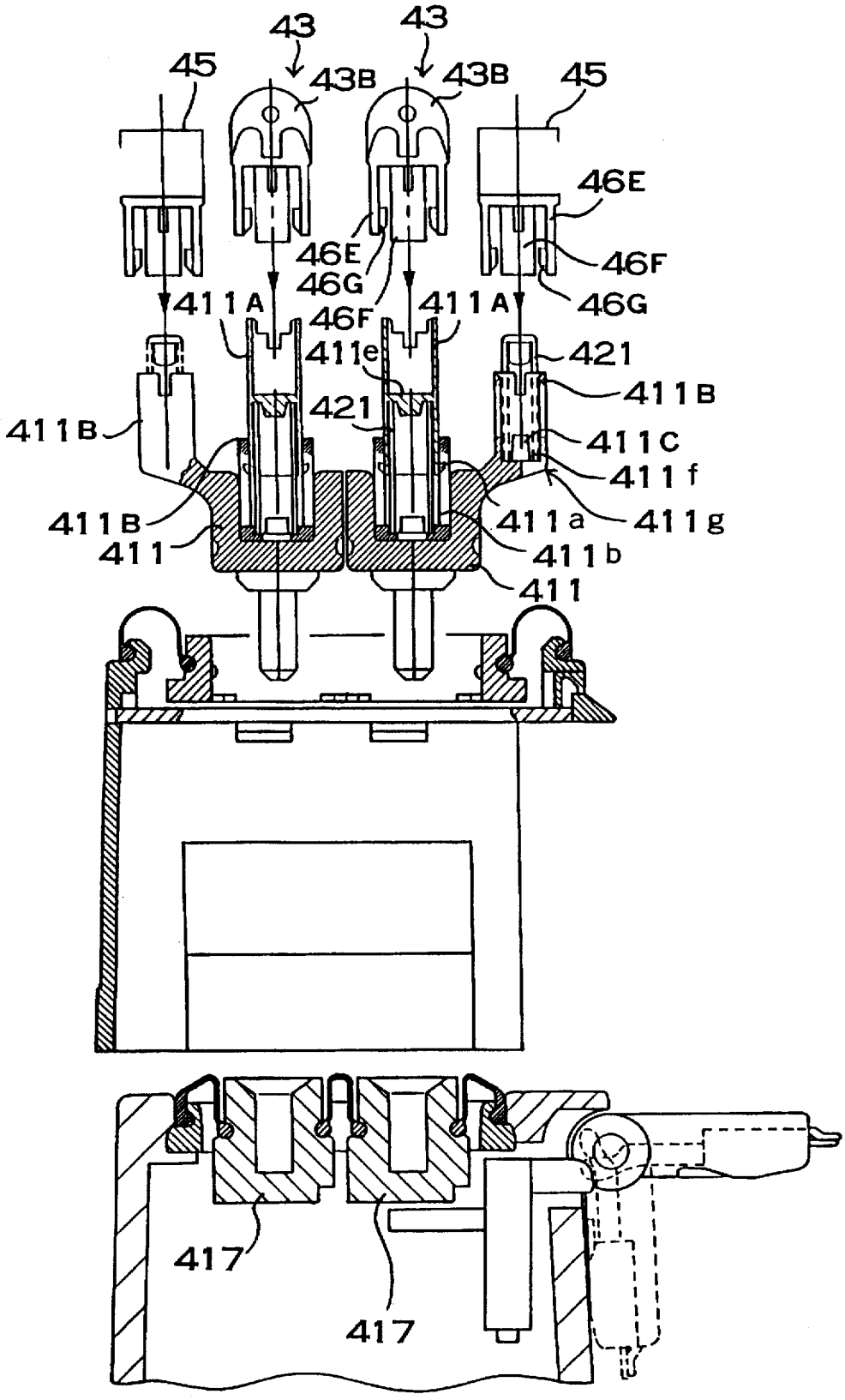
FIG. 16 is partial cross sectional side view showing the coupling condition of the arched inner blade and the sub inner blade in the inner blade stage.

As shown in the FIG. 16, the inner blade connects the arched inner blade 43 and the sub inner blade 45 in the inner blade stage 411. The two rows of arched inner blades 43 are moved in an opposing reciprocal motion, and allow also the two rows of sub inner blades 45 provided in the external side of the arched inner blades 43 to move in an opposing reciprocal motion. The one row of arched inner blade 43 and the one row of sub inner blade 45 are made in one piece, and are connected in the two inner blade stages 411 vibrating relative each other in an opposite manner.

As shown in the FIG. 16, the arched inner blade 43 is manufacture with several sheets of blade plates 43B arranged in parallel and inserted into plastic. The blade plate 43B is made of metal, and the upper extremity is bent so that it enters in contact with the inner face of the arched outer blade 41 that is bent like an arch.

As shown in the FIG. 8, the extremity of the sub inner blade 45 is bent in the form of an inverse upside down "J", it is made of metal and provided with the comblike slit 431, and like the arched inner blade 43 it is mounted and inserted into plastic. The upper face of the sub inner blade 45 rubs against the inner face of the parallel blade 42A, and cuts the beard that is introduced into the slit ports 44 of the parallel blade 42A.

Bending the inner blade base 430 made of stainless steel or other with the cross-sectional form of an inverse upside down "J", the sub inner blade 45 shown in the figure, forms several parallel slits 431 in the bent part. As a result, several inner blade main pieces 432 are formed in the narrow part located between the slits 431. Each inner blade main piece 432 is provided with the base part connecting the inner blade base 430, the beard cutting blade portion 434 bent insersely perpendicular to the upper extremity of the base part 433, and the horizontal part 436 that is bent downward horizontally from the edge of the beard cutting blade portion 434. The base part 433 and the beard cutting blade portion 434 or the beard cutting blade portion 434 and the bent part of the horizontal part 436 are shaped in an R-shape. Further, the upper face of the beard cutting blade portion 434, is formed into the sharply grinded edge 435. Then the sub inner blade 45 is mounted at the position where it rubs the inner face of the above mentioned outer blade 42 with slit ports, and moves in a reciprocating manner through the coupling with the motor built in the electric shaver.

Figure 17:
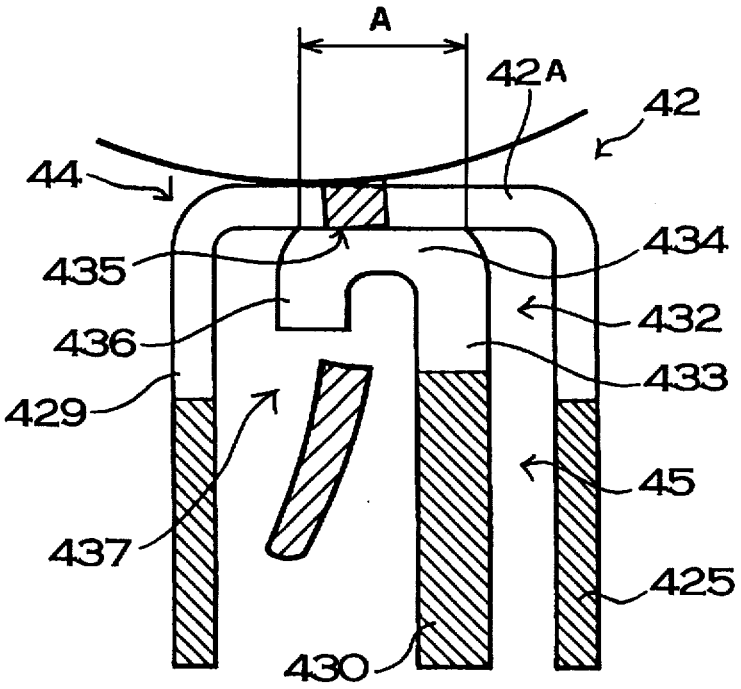
FIG. 17 is a cross sectional view showing the condition in which the sub inner blade cuts the beard introduced into the slit ports.

Then, because this sub inner blade 45 is shaped like an inverse upside down "J", the inner blade base 430 is not like the prior art opposed in both directions, but only in one direction. On the side where there is no inner blade base, there is the space 437. The purpose of the existence of this space 437 is to make the introduction of the beard easier from the lateral face of the outer blade 42 with slit ports. Consequently, the beard that has been introduced from the slit ports 44 of the outer blade 42 with slit ports, is cut by the edge 435 of the beard cutting blade portion 434. The edge 435 is shaped by the beard cutting blade portion 434 of the inner blade main piece 432, and because it fits the span A of the FIG. 17, the introduced beard will not be cut if it does not enter this span A. The vicious beard like a long beard is mostly introduced from the lateral face part 429 of the outer blade 42 with slit ports. Therefore, owing to the space 437 existing at the lower end span of the above described downward vertical part 43G, the introduction of the beard is not obstructed.

The vicious beard that has been introduced through the lateral face part 429 of the outer blade 42 with slit ports, reaches the edge 435 of the beard cutting blade portion 434 via the space 437, and can be shaved.

Figure 18:
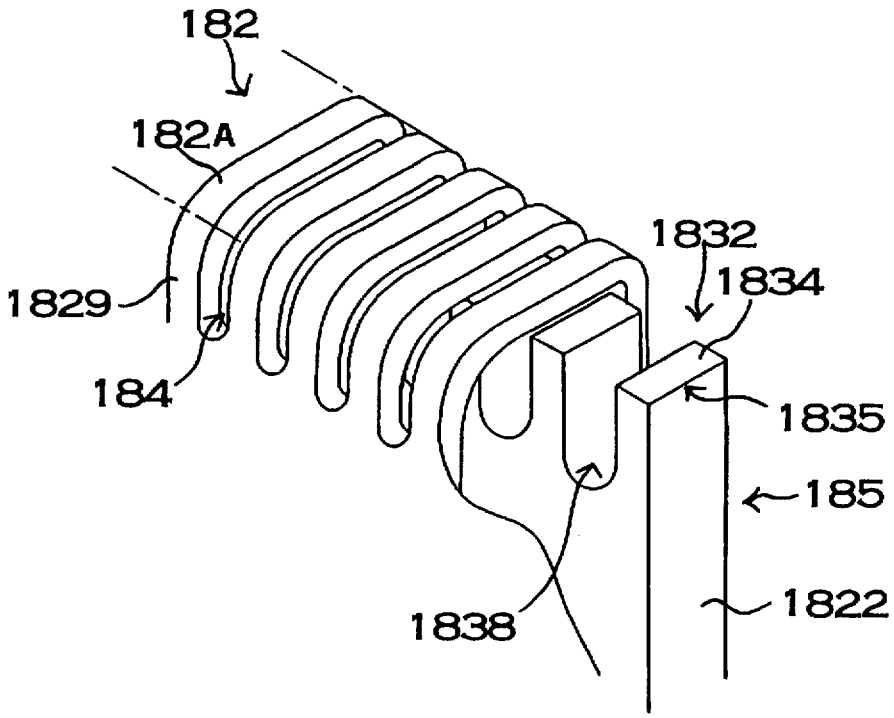
FIG. 18 is an oblique view showing the inner blade in an embodiment of the present invention.

FIG. 18 shows a sub inner blade of a different construction.

This sub inner blade 185 shown in this Figure is formed by processing the inner blade main material 1822 made of a stainless steel sheet or the like. The inner blade main material 1822 is a rectangular stainless steel sheet of a thickness of about 0.1 mm to 3 mm. In one of the long sides of this rectangular inner blade main material 1822, several blade ditches 1838 are shaped. A few tens of blade ditches 1838 are cut into the inner blade main piece from one end to the other end of the side at some interval. Between two adjacent blade ditches 1838 the protuberance part is shaped; this is the part that forms the inner blade main piece 1832. The inner blade main piece 1832 is shaped with the exact number of intervals 1838 or the above mentioned blade ditch 1838. The upper extremity of the inner blade main piece 1832 mounts the beard cutting blade portion 1834 that is grinded, moves together with the outer blade 182 with slit ports and shapes the edge 1835 cutting the beard.

The grinding of the beard cutting blade portion 1834 can be done before the above mentioned blade ditch 1838 is shaped or after the shaping of the blade ditch 1838.

Figure 19:
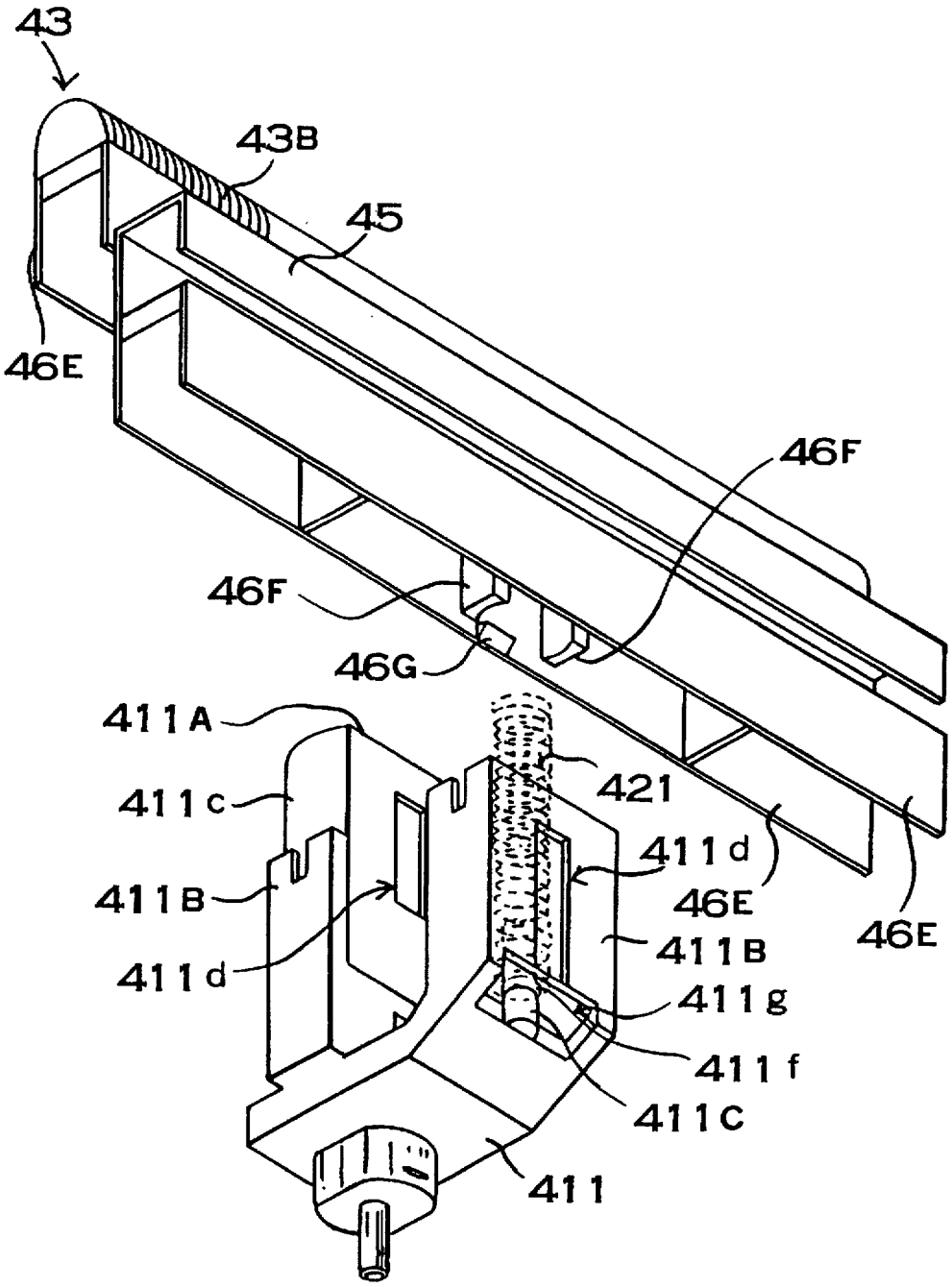
FIG. 19 is an oblique view showing the coupling part of the arched inner blade and the sub inner blade in the inner blade stage.

The plastic body inserting the blade plate 43B of the arched inner blade 43, or the metallic blade of the the sub inner blade 45 is made in one piece with the inner side of the parallel side wall 46E mounted on the opposite side and parallel, as shown in FIG. 19, and with a pair of the connecting support struts 46F. The connecting support strut 46F is connected and inserted into the vertical column 411B of the inner blade stage 411. The central spring 421 pressing in a flexible manner the sub inner blade 45, is mounted between the connecting support struts 46F as shown by the dotted line in the FIG. 19. Therefore, the interval of the connecting support struts 46F has been designed slightly larger than the outer circumference of the central spring 421 to allow insertion of the central spring 421 in between. Furthermore, the inner side that is the opposing face of the connecting support strut 46F, has been bent to form a cavity at the center to mate the surface of the central spring 421, as shown in FIG. 19. The interval of the outer side of the connecting support struts 46F has been designed to almost be the same as the interval of the inner side of the vertical column 411B since it is inserted into the vertical column 411B of the inner blade stage 411.

Furthermore, the parallel side wall 46E forms the lock 46G protruding at the inner face. When connecting the inner blade to the inner blade stage 411, the lock 46G is a locking device preventing easy releasing from the inner blade stage 411. The lock 46G is located at the center of the parallel side wall 46G and the lower extremity is made in one piece with it. Further, as shown in FIG. 19, to allow smooth insertion of the lock 46G into the inner blade stage 411, the lock 46G is designed like a hook with tapered opposing faces. When the inner blade stage 411 has connected the inner blade, the lock 46G is introduced in the latching window **411*d* of the vertical column 411B, and the inner blade is prevented from releasing from the inner blade stage 411. When inserting and connecting the parallel side wall 46E of the inner blade and the connecting support strut 46F with the vertical column 411B of the inner blade stage 411, that interval is made slightly larger by the elastic deformation of the parrallel side wall 46E, and the lock 46G is introduced into the latching window 411*d* of the vertical column 411B. When the lock 46G is introduced into the latching window 411, the interval of the parallel side wall 46E gets narrower and the lock 466 locks inside the latching window 411*d***.

Because the parallel side wall 46E is inserted into the external side of the vertical column 411B of the inner blade stage 411, and the connecting support strut 46F into the inner side of the vertical column 411B of the connecting support strut 46F, there is an interval between the parallel side wall 46F and the connecting support strut 46F, designed so that the vertical column 411B of the inner blade stage 411 can be introduced. The sub inner blade 45 is directly connected to the inner blade stage 411 and the arched inner blade 43 mounted at the inner side of the sub inner blade 45 connects the inner blade stage 411 via the up-down stage 411A. The up-down stage 411A, as shown in the FIG. 16, presses by the central spring 421 that is a coil spring, and is connected to the vertical column 411B of the inner blade stage 411 to allow up-down motion.

The stopper protuberance **411*a* is provided at the lower extremity of the up-down stage 411A to prevent it from coming off easily from the vertical column 411B. The stopper protuberance 411*a* hooked into the upper edge of the retaining slits 411*b* designed vertically along the side surface of the vertical column 411B, prevents the up-down stage 411A from coming off the vertical column 411B. The up-down stage 411A is inserted into the vertical column 411B to allow the up-down motion in a vertical posture. To keep the vertical posture of the up-down stage 411A, a shallow ditch is shaped in the opposite face of the vertical column 411B that is designed so that the sliding surface 411*c* of the up-down stage 411A follows these ditches. The up-down stage 411A connects the arched inner blade 43 at its upper extremity. The arched inner blade 43 is connected in a manner that it does not allow up-down motion compared with the up-down stage 411A. This is because the arched inner blade 43 is moved up and down when the up-down stage 411A moves up and down. Like the shape of the upper part of the vertical column 411B on both sides, the upper extremity of the up-down stage 411A is opened with the latching window 411*d* on both side surfaces to catch the lock of the inner blade. Furthermore, the up-down stage 411A is designed like a square column to hold the central spring 421, and is provided at the center with the base plate 411*e* that presses the upper edge of the built-in central spring 421. The lower face of the base plate 411*e* is shaped like a protuberance to introduce the upper extremity of the central spring 421**.

The vertical column 411B of the inner blade stage 411 is provided with the insertion rod 411C at the lower part of the inner side to determine the position of the central spring 421. The insertion rod 411C protrudes from that surface as shown in the FIG. 16 and FIG. 19, and is made in one piece with the retaining flange **411*f* that catches the central spring. The retaining flange 411*f* protrudes between the spirals of the spiral type central spring 421 and catches the central spring 421. Therefore, the width of the retaining flange 411*f* is designed to allow insertion between the spirals of the central spring 421. Catching the lower end of the central spring 421, the retaining flange 411*f* prevents the coming off of the central spring 421 from the insertion rod 411C when the retaining flange 411*f* is released from the inner blade stage 411 of the inner blade. But, if the central spring 421 is strongly pulled, or if the central spring 421 is twisted and pulled, the central spring 421 will deform or the spiral central spring 421 will come off the retaining flange 411*f*, and it is then possible to take the central spring 421** off.

As shown in the FIG. 16, the window **411*g* is opened in the lower face of the vertical column 411B connecting the sub inner blade 45 and positioned at the bottom of the retaining flange 411*f*. The retaining flange 411*f* positioned at the upper side of the window 411*g* is provided at one side of the insertion rod 411C. The up-down position of the retaining flange 411***f* provided with the insertion rod 411C, is designed to be the position that catches the lower extremity of the central spring 421 that is to be inserted into the insertion rod 411C.

To prevent the releasing of the hooked lock 46G of the mounted sub inner blade 45, the slit type latching window 411*d* is opened and extended up and down at the side face in the vertical column 411B of the inner blade stage 411. The lock 46G of the sub inner blade 45 is hooked to the latching window 411*d* to prevent the sub inner blade 45 mounted in the inner blade stage 411 to come off easily. But, if the sub inner blade 45 is strongly pulled, the lock 46G of the sub inner blade 45 comes off the latching window 411*d* and the sub inner blade 45 can be separated from the inner blade stage 411.

The central spring 421 is inserted into the insertion rod 411C mounted in the inner blade stage 411, and pushes flexibly the sub inner blade 45 and the the up-down stage 411A. The sub inner blade pushed out by the central spring 421, is pushed flexibly to the inner face of the outer blades 42 with slit ports, and efficiently shaves the beard penetrating the outer blades 42 with slit ports.

Figure 20:
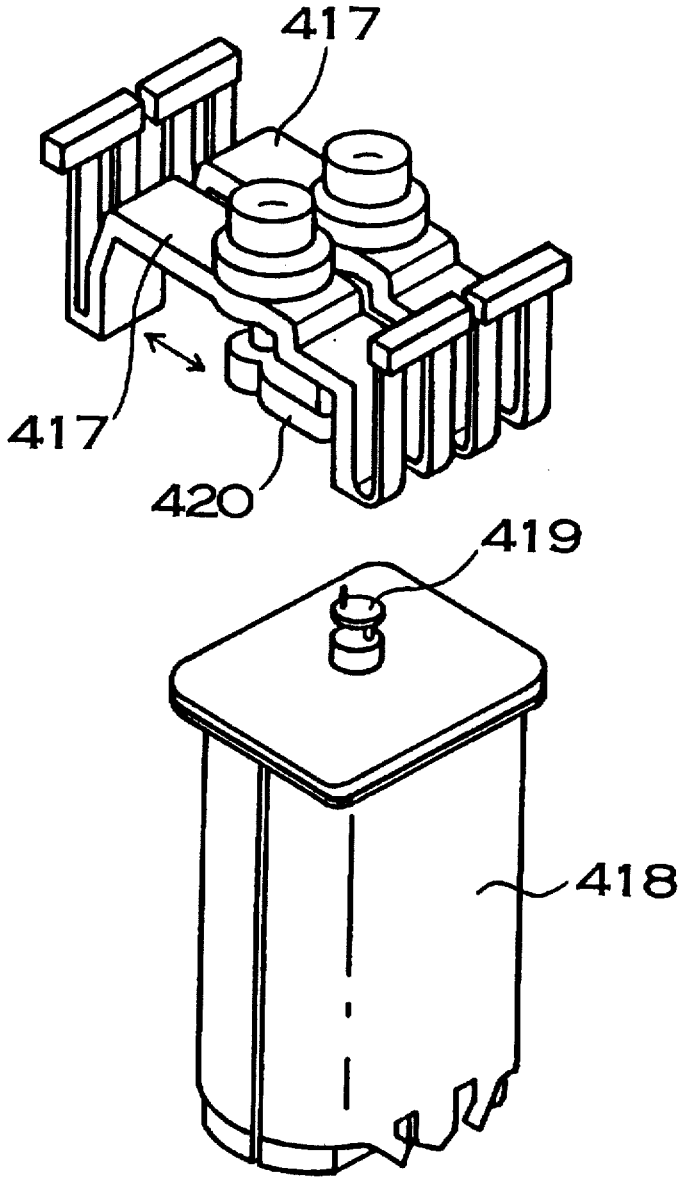
FIG. 20 is an oblique view showing the inner blade stage driving mechanism.

The two inner blade stages 411 that vibrate the arched inner blades 43 and the sub inner blades 45, as shown in FIG. 20, move in an opposing reciprocating motion produced by the driving mechanism mounted in the case. The driving mechanism is provided with the vibrator 417 connecting the inner blade stage, the motor 418 giving a reciprocating motion to this vibrator 417, and the inverter mechanism changes the rotating motion of the motor 418 into a reciprocating motion that moves the vibrator 417 in a reciprocating motion.

The inverter mechanism is provided with the cam shaft 419 fixed to the rotating shaft of the motor 418, and with the connecting rod 420 connecting the eccentric axis of this cam shaft 419 to the vibrator 417. To vibrate in the opposite direction, the two connecting rods 420 are mounted symmetrically compared with the center of the rotating shafts, at the center of the cam shaft 419. When one connecting rod 420 is moving to the right side, the other connecting rod 420 moves to the left side, giving an opposite reciprocating motion to the inner blade stage 411.

The driving mechanism of this construction, turns the cam shaft 419 by means of the motor 418, and changes the rotating motion of the eccentric shaft of the cam shaft 419 to a reciprocating motion by the connecting rod 420, and the vibrator 417 moves in a reciprocating motion. At the center of the vibrator 417, the hole connecting the coupling rod of the inner blade stage 411, is opened vertically. The coupling rod of the inner blade stage 411 is inserted into the hole of the vibrator 417, and the inner blade stage 411 is connected to the vibrator 417.

As this invention may be embodied in several forms without departing from the spirit of the essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An electric shaver comprising:

a pair of longitudinally extending outer blades disposed parallel to one another;

a pair of arched outer blades disposed parallel and adjacent to one another and between said longitudinally extending outer blades, each of said arched outer blades comprising a mesh cutter formed of an arch-shaped thin metallic sheet;

wherein said arched outer blades and said longitudinally extending outer blades face in an upward direction, and said arched outer blades protrude further in said upward direction than said longitudinally extending outer blades;

wherein each of said longitudinally extending outer blades comprises a metal sheet having an upper face and a side face substantially perpendicular to said upper face, with transversely extending whisker entry ports formed in said metal sheet so as to open through both said upper face and said side face;

wherein a pair of inner blades are reciprocatably movably mounted relative to said longitudinally elongated outer blades, respectively, and have beard cutting parts reciprocatably movably mounted against inner faces of said longitudinally elongated outer blades, respectively;

wherein each of said inner blades comprises a flat inner blade main piece with an end edge having a flat upper face for rubbing against said inner face of a respective one of said longitudinally elongated outer blades, said end edge being formed with plural blade ditches and plural protuberance parts, each protuberance part being defined between an adjacent pair of said blade ditches and having a sharpened extremity edge constituting a beard cutting edge; and wherein said flat inner blade main pieces are narrower in a transverse direction than said longitudinally elongated outer blades, respectively, and spaces are formed on both sides of both of said flat inner blade main pieces between said flat inner blade main pieces and said longitudinally elongated outer blades, respectively.

2. An electric shaver as recited in claim 1, wherein each of said flat inner blade main pieces is constituted by a stainless steel sheet.

3. An electric shaver as recited in claim 2, wherein each of said stainless steel sheets has a thickness of 0.1 mm to 3 mm.

* * * * *